US006081938A

United States Patent [19]

McClure et al.

[11] Patent Number: 6,081,938

[45] Date of Patent: Jul. 4, 2000

[54] DUAL-FLUSH VALVE

[75] Inventors: Richard C. McClure; John C. McKay, both of Placentia; Miguel C. Garcia, La Puente, all of Calif.

[73] Assignee: FluidMaster, Inc., San Juan Capistrano, Calif.

[21] Appl. No.: 09/152,749

[22] Filed: Sep. 14, 1998

[51] Int. Cl.[7] ..... E03D 1/14

[52] U.S. Cl. ..... 4/325; 4/324

[58] Field of Search ..... 4/325, 324, 326, 4/327

[56] References Cited

U.S. PATENT DOCUMENTS

| | | | |
|---|---|---|---|
| 3,406,940 | 10/1968 | Kertell . | |
| 3,639,918 | 2/1972 | Mansukhani . | |
| 3,806,962 | 4/1974 | Sievers . | |
| 4,138,749 | 2/1979 | Clark . | |
| 4,296,505 | 10/1981 | Chien-Sheng . | |
| 4,392,260 | 7/1983 | Bensen . | |
| 4,527,296 | 7/1985 | Musgrove . | |
| 4,557,000 | 12/1985 | Strangfeld . | |
| 4,566,140 | 1/1986 | Musgrove . | |
| 4,571,753 | 2/1986 | Strangfeld . | |
| 4,809,367 | 3/1989 | Scott . | |
| 4,882,793 | 11/1989 | Thompson . | |
| 5,123,124 | 6/1992 | Brower . | |
| 5,157,795 | 10/1992 | Pasquin . | |
| 5,289,594 | 3/1994 | Wiewiorowski et al. | 4/325 |
| 5,305,474 | 4/1994 | Nardi et al. . | |
| 5,333,331 | 8/1994 | Battle . | |
| 5,333,332 | 8/1994 | Kam . | |
| 5,544,368 | 8/1996 | Wang . | |
| 5,659,903 | 8/1997 | Hammarstedt . | |
| 5,669,082 | 9/1997 | Sun . | |

*Primary Examiner*—David J. Walczak
*Attorney, Agent, or Firm*—Richard L. Myers

[57] ABSTRACT

A flush valve is adapted to be mounted in the tank of a toilet and includes a selector assembly and a flush valve. The selector assembly is accessible from outside the toilet and provides for initiation of the flushing operation and an alternative choice between a larger flush water volume and a smaller flush water volume. A support structure provides for both axial and radial movement of the selector assembly relative to the flush valve in order to facilitate mounting and alignment of the flush valve assembly. A slide mechanism provides for variation of at least the smaller flush water volume.

10 Claims, 7 Drawing Sheets

DUAL-FLUSH VALVE

BACKGROUND OF THE INVENTION

1. Field of the Invention

This invention relates generally to toilet flush valves and, more specifically, to valves providing alternative flush water volumes, 2. Discussion of the Prior Art Toilets typically include a bowl which is adapted to receive liquid and solid waste, and a tank which provides a reservoir of water for flushing the waste from the bowl. Apparatus which is commonly mounted in the tank includes a flush valve assembly which is operable by the user to initiate the flushing of the bowl. A fill valve is also commonly mounted in the tank to refill the tank with a predetermined amount of water to be used in the next flushing operation.

Flush valve assemblies can vary considerably in their complexity, but typically include a flush valve, a float and an actuation mechanism. By operation of the actuation mechanism, the flush valve opens to release water from the tank into the bowl and closes when the float reaches a predetermined level indicative of the amount of water left in the tank.

More complex flush valve assemblies, such as that disclosed in PCT application number WO9502738 provide alternative flush water volumes. Prior to initiating the flushing operation, the user chooses between a large flush water volume for solid waste, and a smaller flush water volume for liquid waste. In the past, this selection has been made by a mechanical switch assessible to the user from outside the tank. Once the selection has been made, the associated flushing operation is initiated by operation of a pull tab also assessible from outside the tank.

These dual-flush toilet valves commonly include a selection apparatus which is mounted to the top of the tank, and a flush valve which is mounted to the bottom of the tank. With this design it is often desirable to adjust the axial distance separating the flush valve and the selection apparatus in order to accommodate tanks of various heights. In the past, this axial adjustability was provided by a shaft extending from the selector apparatus downwardly toward the flush valve. The length of this shaft had to be determined and the shaft cut to accommodate a particular height of the tank. This was a cumbersome procedure which had to be carried out with each installation. Unfortunately, once the shaft was cut, the valve assembly was rendered useless for taller toilet tanks. Mounting has also been a problem in tanks having mounting holes slightly misaligned. There has been no radial adjustability in prior flush valves to accommodate these toilets.

Within the tank, a hollow float has been provided with a water inlet and an air outlet. Selection of the reduced flush water volume has provided a controlled release of air from the air outlet to atmospheric pressure. This structure has facilitated the passage of water into the hollow float thereby decreasing the buoyancy of the float during the flushing operation and prematurely closing the flush valve.

U.S. Pat. No. 5,228,144 discloses a structure for adjusting the flush volume by controlling a release of air from the hollow float into a pressure tube which extends into the water in the tank. This tube provides a variable pressure that is dependent upon the level of the water in the tank. By adjusting the level of the tube in the tank, the pressure can be varied to provide a predetermined but adjustable flush water volume.

SUMMARY OF THE INVENTION

In accordance with the present invention, a flush valve assembly is provided with a selector apparatus including multiply actuators, such as buttons, which not only initiate the flushing procedure, but also choose between alternative flush water volumes. The step for initiating the flushing operation and for selecting the desired flush volume occurs substantially simultaneously with the single push of the associated button.

For the reduced flush volume, the float can be vented through a slide assembly and into a tube having a variable pressure dependent of the depth of the tube in the water. This will provide the reduced flush volume with a predetermined variable volume.

The slide associated with the air vent includes a first planar member having a aperture in fluid communication with the hollow float. A second slide member has a second aperture which is movable between first and second positions associated with the first and second flush water volumes. Movement of the second slide member is dependent upon operation of two flush actuators. The first flush actuator initiates the first flush with the lesser volume dependent upon the position of the pressure tube, while the second actuator initiates the flushing operation with the greater second flush volume.

The axial dimension of the flush valve assembly is adjustable using mating ridges and a retainer ring. This adjustment structure provides a variable distance between the flush valve and a lever associated with the selection apparatus. The shaft extending from the actuators to the lever is provided with a consent length and need not be cut to fit the assembly to the particular height of the tank. Radial adjustment of the selection apparatus relative to the flush valves accommodates toilets having mounting holes which are slightly misaligned.

In a first aspect of the invention, a toilet includes a bowl adapted to receive waste to be flushed, and a tank providing a reservoir of water to flush the bowl. A flush valve assembly is disposed in the tank and operable to release the water into the bowl in a first volume associated with the flushing of liquid waste and a second volume greater than the first volume associated with the flushing of solid waste. A selector apparatus is included in the flush valve assembly and accessible from outside the tank for initiating a flushing operation and for selecting one of the first flush volume and the second flush volume. A flush valve included in the flush assembly is responsive to operation of the selector assembly to release the water into the bowl. The flush valve is responsive to operation of the selector apparatus to select the first flush volume by opening the flush valve at the beginning of a first time period associated with the first flush volume and by closing the flush valve at the end of the first time period. Similarly, the flush valve is responsive to operation of the selector apparatus to select the second flush volume by opening the flush valve at the beginning of a second time period associated with the second flush volume and closing the flush valve at the end of the second time period. In this aspect of the invention, the second time period is greater than the first time period and the first time period is variable to adjust the first flush volume. A float having a least one wall forming a hollow chamber includes first portions of the wall defining at least one water inlet for receiving water at a first water entry rate associated with the first flush volume, and a second water entry rate associated with the second flush volume. Second portions of the wall define at least one air outlet hole for releasing air from the hollow chamber at a first air release rate associated with the first water entry rate, and a second air release rate associated with the second water entry rate.

In another aspect of the invention, a flush valve assembly is adapted to be mounted in a toilet tank having a top and a bottom, to controllably release water from the tank to flush the toilet. The flush valve assembly includes a flush valve coupled to a first column, and a selector assembly coupled to a second column. One of the first and second columns includes the plurality of first ridges while the other column includes at least one second ridge mating with the first ridge in a plurality of patterns each providing a different spaced relationship between the flush valve and the selector assembly. A retainer is disposed around the first and second columns to maintain the first ridges and the second ridge in a predetermined one of the mating patterns.

In another aspect of the invention, the flush valve assembly extends generally along an axis and is adapted for mounting in a toilet tank having a top and a bottom, to controllably release water from the tank to flush the toilet. The assembly includes a flush valve adapted to be mounted at the bottom of the tank and a selector assembly disposed at the top of the tank. A first push button is included in a selector assembly and movable to operate the flush valve to release a first volume of the water from the tank. A second push button, also included in the selector assembly, is movable to operate the flush valve to release a second volume of the water from the tank. The second volume of water is different from the first volume of water. In this aspect, a slide is movable by operation of the first push button to a first position associated with the first volume of the water and is movable by operation of the second push button to a second position associated with the second volume of water. The first and second push buttons are adapted to be pushed axially while the slide is movable generally transverse to the axis between the first position and second position.

In a further aspect of the invention, a method for flushing a toilet to alteratively initiate a flushing operation with a first flush water volume and a second flush water volume, includes the step of providing a selector apparatus having a first actuator and a second actuator. Operation of the first actuator initiates the flushing operation with the first flush volume while operation of the second actuator initiates the flushing operation with the second flush water volume. This operation includes the steps of initiating the flushing operation by pushing a first button, and selecting the first flush volume by pushing the first button. These initiating and selecting steps occur substantially simultaneously.

These and other features and advantages of the invention will become more apparent with a description of preferred embodiments and reference to the associated drawings.

DESCRIPTION OF THE PREFERRED EMBODIMENTS AND BEST MODE OF THE INVENTION

Figure 1:
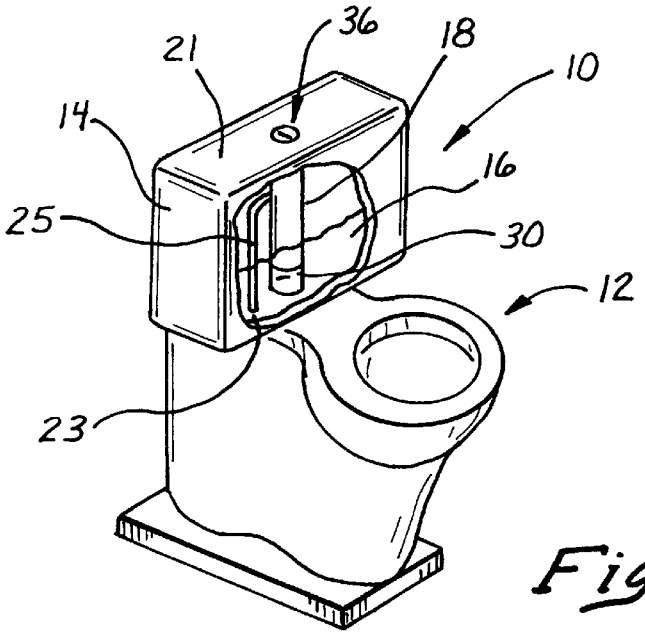
FIG. 1 is a perspective view of a toilet partially in phantom to illustrate a flush valve assembly of the present invention mounted in the tank of the toilet.

A toilet is illustrated in FIG. 1 and designated generally by the reference numeral 10. The toilet 10 includes a bowl 12 which is adapted to receive liquid and solid waste. A tank 14 is typically mounted above the bowl 12 and forms a reservoir for water 16 used to flush the bowl 12. A flush valve assembly 18 is mounted between a top 21 and a bottom 23 of the tank 14. The flush valve assembly 18 includes a pressure tube 25 which extends into the water 16 as described in greater detail below.

Figure 2:
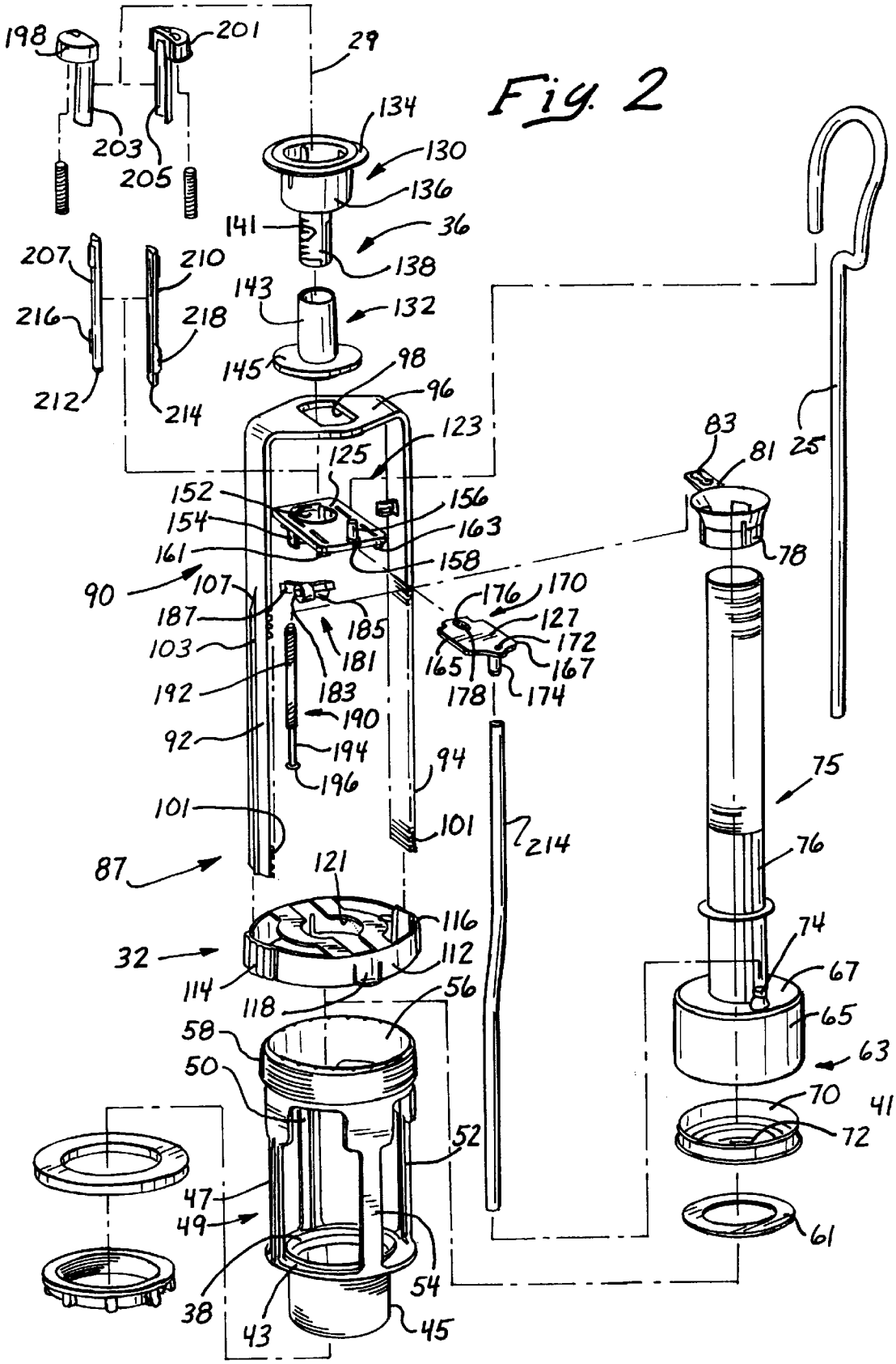
FIG. 2 is an assembly perspective view illustrating various components of the flush valve assembly of a preferred embodiment.
Figure 3:
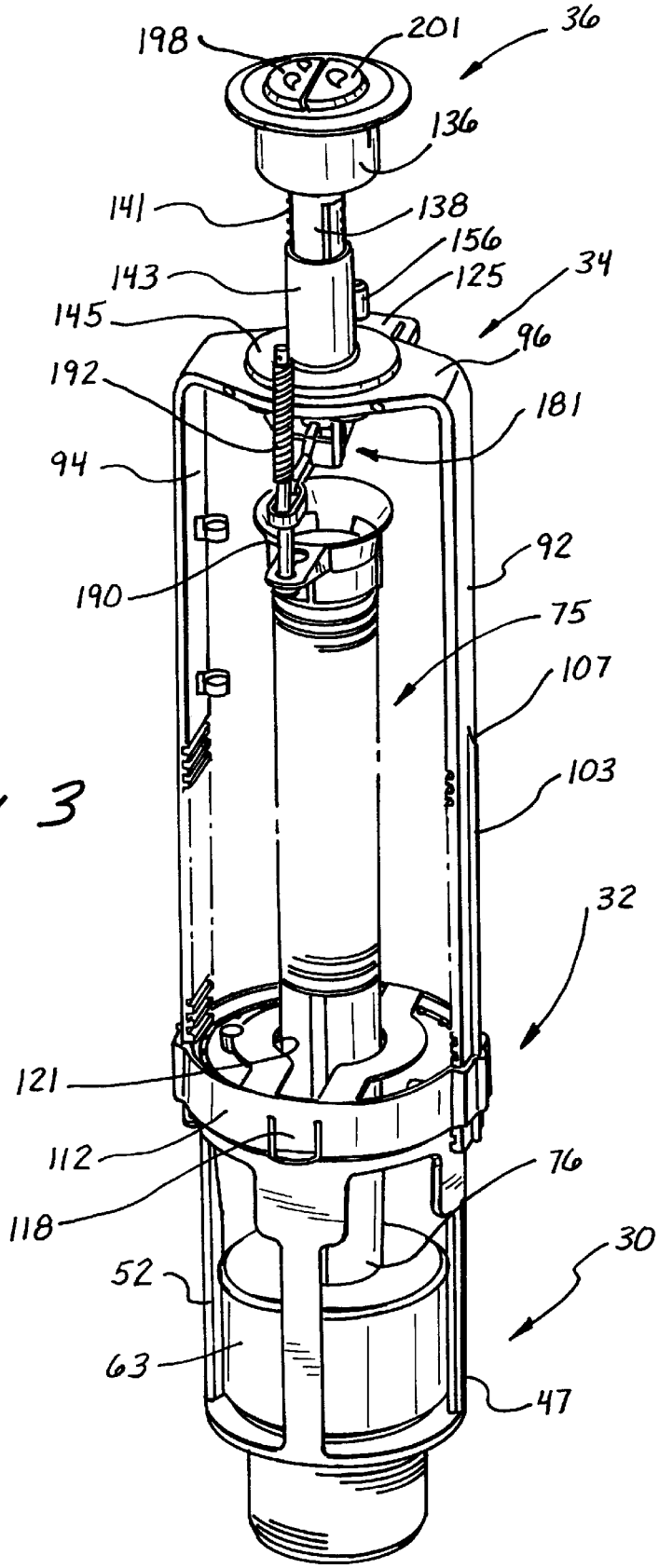
FIG. 3 is a front perspective view of the flush valve assembly of FIG. 2.
Figure 4:
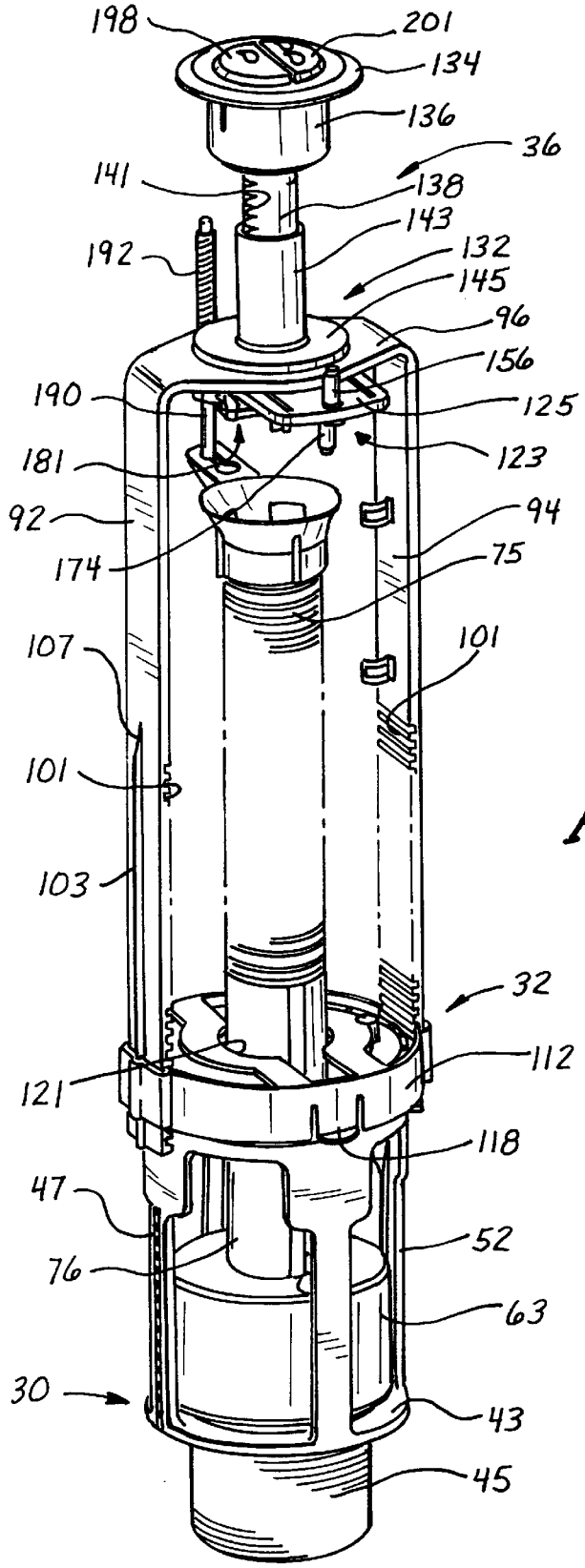
FIG. 4 is a back perspective view of the flush valve assembly of FIG. 2.
Figure 5:
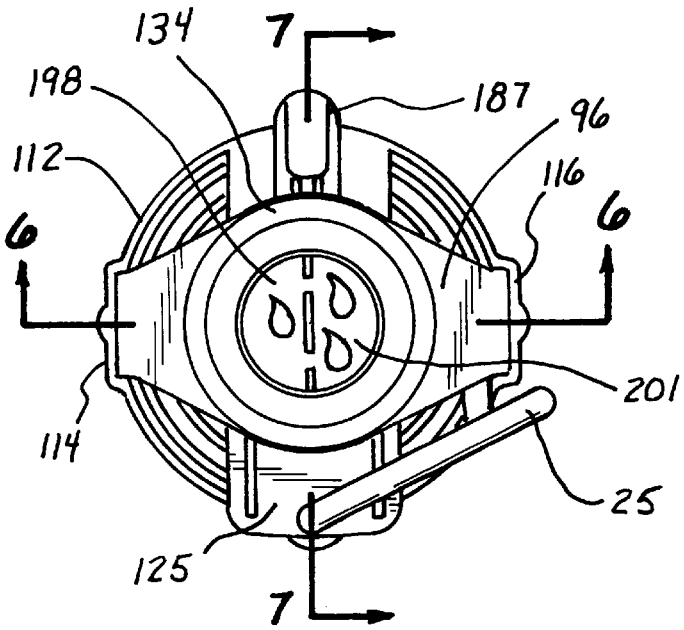
FIG. 5 is a top plan view of the FIG. 2 embodiment.
Figure 8:
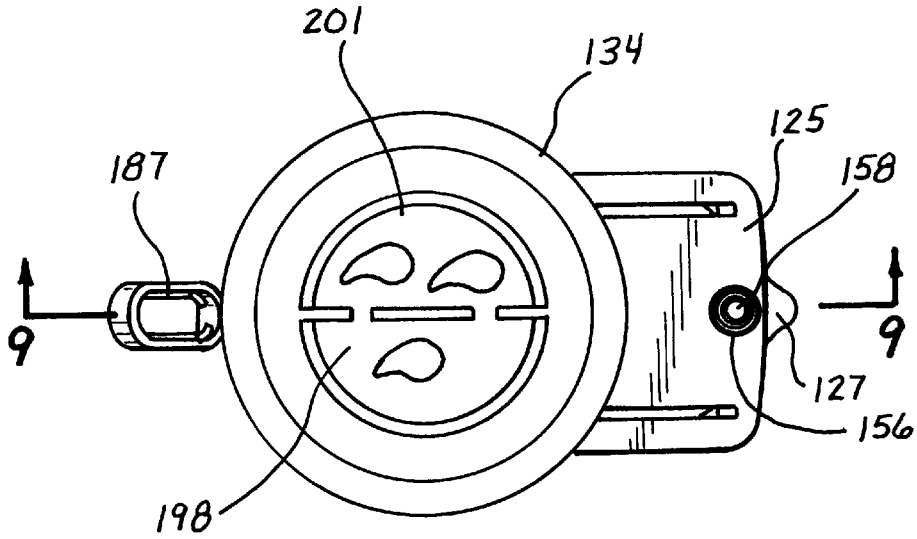
FIG. 8 is a top plan view of slide mechanism associated with the FIG. 2 embodiment.

An exploded view of the flush valve assembly is illustrated in FIG. 2 with assembled views presented in FIGS. 3 and 4. From these views, it can be seen that the flush valve assembly 18 of a preferred embodiment has an axis 29 and includes generally a flush valve 30, an axial adjustment structure 32, a slide mechanism 34, and a selector assembly 36. In operation, the flush valve 30 releases water from the tank 14 into the bowl 12 in response to the operation of the selector assembly 36. Depending upon the operation of the selector assembly 36, the slide mechanism 34 produces a flush water volume which is selectable between a small variable volume, intended to flush liquid waste, and a larger fixed volume, intended to flush solid waste. The axial structure 32 enables the flush valve assembly 18 to be adjusted for mounting in tanks, such as the tank 14, having different distances separating the top 21 and the bottom 23.

As best illustrated in FIG. 2, the flush valve 30 includes a valve seat 38 which is formed in a base 40 and a valve element illustrated generally at 41. The valve seat is formed in a ring 43 which is mounted to the bottom 23 of the tank 14 by an exteriorly threaded pipe 45. Integral with the ring 43 and extending upwardly from the bottom 23 of the tank 14 are a plurality of columns 47, 50, 52 and 54 which extend toward the selector assembly 36 and support a coaxial cylinder 56 having circumferential ridges 58. These ridges 58 are disposed to extend on the columns 47, 50, 52 and 54 generally transverse, such as perpendicular, to the axis 29.

In this particular embodiment, the valve element 41 comprises an elastomeric washer 61 which is mounted to a hollow float 63 having a circumferential wall 65 extending between a top wall 67 and a bottom wall 70. In this case, the bottom wall 70 forms a water inlet aperture 72 while the top wall 67 forms an air outlet aperture 74. The float 63 is integral with an overflow spout including an upstanding tube 76 and a flared top ring 78 having a radial flange 81 with an aperture 83. The top ring 78 can be adhered to the tube 76 or otherwise disposed in a fixed relationship with the tube 76. In a preferred embodiment, the flange 81 extends radially on a side of the tube 76 opposite to the aperture 74 associated with the float 63.

A top member 90 forms with the base 40 a support structure 92 which maintains the selector assembly 36 in a spaced relationship with the flush valve 30. This spaced relationship is adjustable in a preferred embodiment by operation of the axial adjustment structure 32.

In the illustrated embodiment, the top member 90 is formed with columns 92 and 94 which extend axially from a connecting flange 96 having a slot 98. A plurality of ridges 101 are formed on the inner surfaces of the columns 92 and 94. These ridges 101 are sized and configured to mate with the ridges 58 on the base 40 in a plurality of patterns which provide different distances of separation between the flush valve 30 and the selector assembly 36. Radial flanges 103 and 105 extend longitudinally along the outer surfaces of the associated columns 92 and 94. These flanges 103 and 105 terminate at flange ends 107 and 110, respectively, short of the connecting flange 96.

The axial adjustment structure 32 also includes a retainer 112 which functions to hold the ridges 101 of the columns 92 and 94 in a preferred mating relationship with the ridges 58 of the base 49. This retainer 112 in a preferred embodiment is in the form of a ring and is provided with circumferential slots 114 and 116 which are shaped to receive the respective columns 92 and 94 and the associated longitudinally flanges 103 and 105. The circumference of the retainer ring 112 can also be provided with bendable detente tabs 118 which are engageable with the ridges 58 to maintain the retainer 112 in its preferred operative disposition. Portions of the retainer 1 12 define a central aperture 121 which is sized to receive the spout 75 associated with the float 63.

In its operative disposition, the retainer 112 encircles the columns 92 and 94 as well as the base 49 circumferentially of the ridges 58. Adjustment of the axial length of the support structure 92 is accomplished by bending the retainer tabs 118 outwardly to free the retainer from the ridges 58. The retainer 112 can then be moved upwardly along the columns 92 and 94 preferably beyond the flange ends 107 and 109. The columns 92 and 94 can then be bent outwardly to remove the ridges 101 of the top member 90 from the ridges 58 of the base 49. This permits the top member 90 to be moved axially relative to the base 49 thereby providing an adjustment in the axial length of the support structure 92. When the ridges 101 have been formed in a new pattern with respect to the ridges 58, the retainer 112 can be lowered to its operative position to maintain the predetermined length of the support structure 92.

In a preferred embodiment, the ridges 58 associated with the base 40 are formed as separate concentric circles having a generally parallel relationship. The ridges 101 associated with the columns 92 and 94 are similarly formed as discrete parallel flanges spaced to mate with the ridges 58. This configuration permits the top member 90 to be rotated relative to the base 49 thereby facilitating alignment of the flush valve assembly 18. This alignment is further facilitated by the selector assembly 36 which is snap-fit through the slot 98 of the flange 96, into a slide subassembly 123 which includes a base 125 and a slide element 127. Neither the selector assembly 36 nor the slide subassembly 123 are fixed to the flange 96 of the top member 90. This coupled with the fact that the structure extending through the slot 98 is smaller than the slot 98 ensures that the resulting combination of the selector assembly 36 and the slide assembly 123 is movable radially with respect to the flange 96. Alignment of the flush valve assembly 18 is thus facilitated for those toilets which have mounting holes in the top 21 and bottom 23 which are slightly misaligned. By rotating the top member 90 relative to the base 49 and/or sliding the selector assembly 36 relative to the flange 96, the flush valve assembly 18 can be easily mounted in any tank such as the tank 14.

Figure 9:
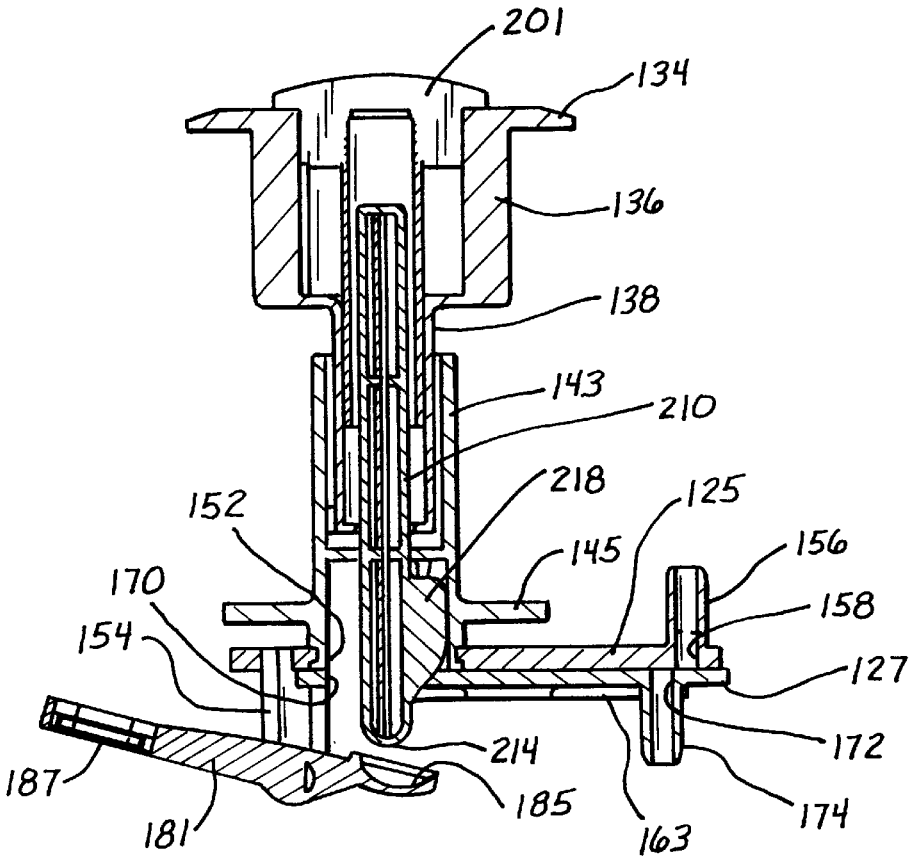
FIG. 9 is an axial cross-section view of the slide mechanism taken along lines 9—9 of FIG. 8.
Figure 6:
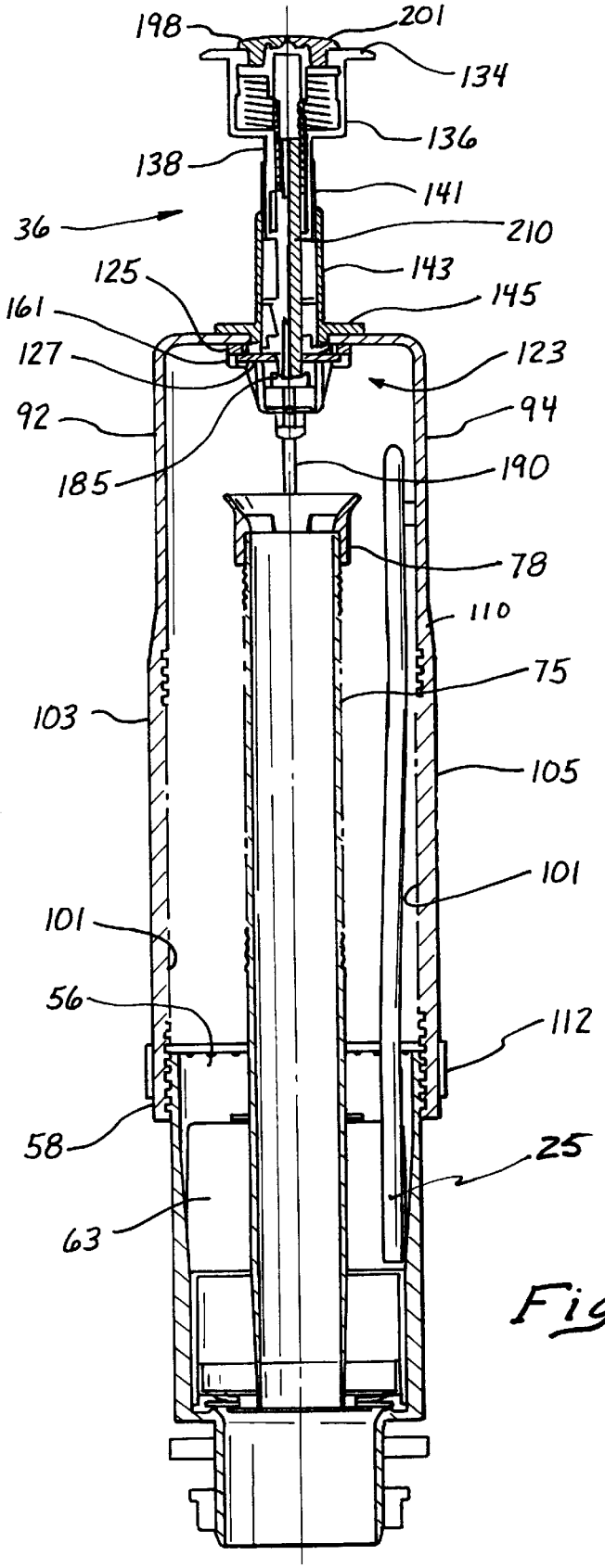
FIG. 6 is an axial cross-section view taken along lines 6—6 of FIG. 5.
Figure 7:
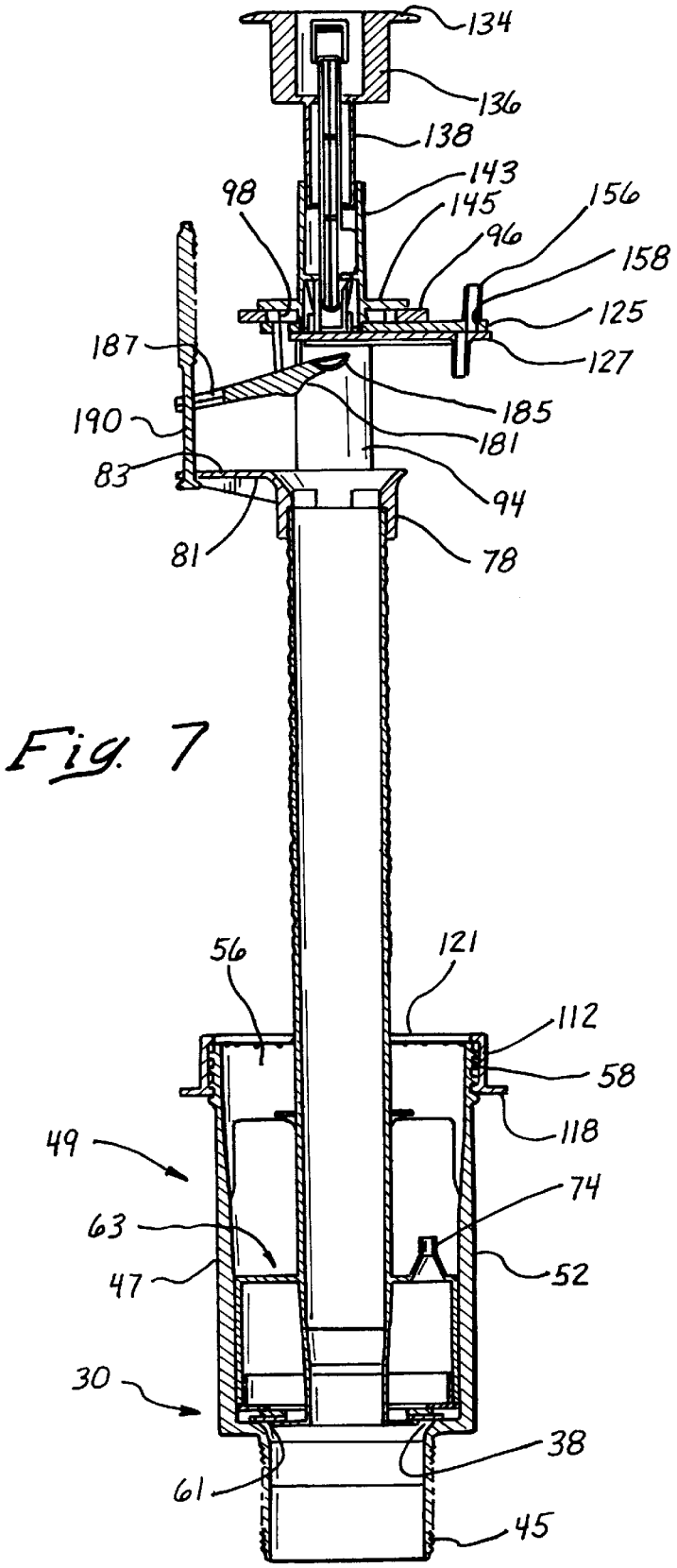
FIG. 7 is an axial cross-section view taken along lines 7—7 of FIG. 5.

The selector assembly 36 is perhaps best illustrated in the cross-section views of FIGS. 6 and 7 and the enlarged view of the FIG. 9. From these views it can be seen that a preferred embodiment of the assembly 36 includes a top housing member 130 and a bottom housing member 132. The top housing member 130 includes an upper flange 134 which seats against the top surface of the top 21 of the tank 14. A cylinder 136 is sized to extend through a hole in the top 21 and to terminate in a cylindrical guide tube 138.

The exterior surface of the guide tube 138 is provided with a bayonet structure 141 which engages opposing elements on a cylinder 143 associated with the bottom housing element 132. This bottom element 132 terminates in a flange 145 which seats against the bottom surface of the tank top 21. A cylindrical snap 147 can be provided beneath the flange 145 to engage a hole 152 in the base 125 of the slide subassembly 123. This base 125 can be provided with a generally flat configuration and oriented in a plane perpendicular to the axis 29 of the flush valve assembly 18. A pair of pivot flanges 154 extend from the bottom side of the base 125, and a tube 156 extends from the top side of the base 125 in fluid communication with a hole 158 through the base 125. The base 125 is also provided with a pair of guides 161, 163 which are oriented to receive opposing sides 165 and 167 of the slide 127.

Portions of the slide 127 include a slot 170 and a hole 172 which opens into a downwardly extending tube 174. The slot 170 is formed in part by a pair of opposing surfaces 176 and 178 which are oriented generally perpendicular to the guides 161, 163 and associated edges 165,167. The slot 170 with its surfaces 176 and 178 is intended to be accessible through the hole 152 of the base 125.

In the illustrated embodiment a lever 181 is mounted to pivot on fulcrum pins 183 which engage the pivot flanges 154 of the base 125. On opposite sides of the pin 183, the lever 181 is formed with an upwardly facing cup 185 and an internally threaded nut 187. A pin 190 is provided with external threads 192 which engage the nut 187, and a shaft 194 which extends through the aperture 83 of the flange 81 and terminates in an enlargement 196. In a manner discussed in greater detail below, it will be apparent that this structure responds to a downward force against the cup 185 by lifting the pin 190 and the spout 75 thereby raising the float 63 and opening the flush valve 30 at the tank bottom 23 (FIG. 1).

In addition to the housing elements 130,132, the selector assembly 36 includes a pair of actuators which in this embodiment are formed as push buttons 198 and 201 and each have a semi-circular configuration. These buttons 198 and 201 are sized to fit within the cylinder 136 and are exposed at the tank top 21. The push buttons 198 and 201 have semi-cylindrical projections 203 and 205 respectively which extend into the guide tube 138. These projections 203 and 205 are adapted to receive associated half-shafts 207 and 210.

The half-shafts 207 and 210, which extend to respective ends 212 and 214, include associated flanges 216 and 218 which extends radially in opposite directions. The half-shafts 207, 210 are preferably of a length sufficient that the ends 212 and 214 engage the cup 185 of the lever 181 with the flanges 216 and 218 extending through the hole 152 in the base 125 and the slot 170 in the slide 127.

In operation, a person will alternatively actuate either the push button 198 or the push button 201. In either case, the associated half-shaft 207 or 210 will be moved axially downwardly until the associated shaft end 212 or 214 applies a downward force against the cup 185. In the manner previously discussed, this will initiate the flushing operation by lifting the float 63 and opening the flush valve 30. Thus, with a single flushing movement, such as the pushing of one of the buttons 198 and 201 in a single direction, the flushing operation can be initiated and the selection of flush volume determined generally simultaneously.

The remaining structure associated with this particular embodiment of the flush valve 18 controls the duration of the flushing operation which is completed when the float 63 moves downwardly to close the flush valve 30. Increasing the duration of the flushing operation, for example by depressing the push button 201, will result in a greater flush water volume for flushing solid waste. Alternatively, decreasing the duration of the flushing operation, for example by depressing the push button 198, will result in a reduced flush water volume for flushing liquid waste.

This remaining structure includes a flexible tube 214 which connects the tube 174 of the slide 127 with the air outlet aperture 74 associated with the float 63. This tube 214 is best illustrated in the cross-sectional view of FIG. 7. A second tube, designated by the reference numeral 25 in FIG. 1, extends into the water 16 in the tank 14 a distance which is adjustable to vary the pressure in the tube 25. This pressure tube 25 is connected to the tube 156 associated with the base 125 of the slide assembly 123. It is the purpose of these tubes 214 and 25 to respond to operation of the push button 198 by bleeding air from the float 63 thereby reducing the buoyancy of the float 63 and causing it to prematurely drop and close the flush valve 30. Reducing the buoyancy of the float 63, results in a shorter flushing period and a smaller flush water volume. Alternatively, operation of the push button 201 is intended to block the tubes 214 and 25 at the slide assembly 123 so that the buoyancy of the float 63 is not reduced thereby resulting in an extended flushing period and a larger flush water volume.

This opening and closing of the tubes 214 and 25 is achieved by the slide assembly 123. As the push button 198 is depressed, its associated half-shaft 207 not only initiates the flushing operation through the pivot 181, but also results in the flange 216 engaging the surface 176 of the slot 170 in the slide 127. This moves the slide 127 relative to the base 125 to a first position where the associated holes 172 and 158 are aligned thereby providing fluid communication between the tube 214 and the pressure tube 25. In the manner previously mentioned, this facilitates venting of air from the float 63 and results in a shorter flushing period.

Alternatively, if the push button 201 is depressed, its associated half-shaft 210 moves downwardly not only to initiate the flushing operation through the lever 181, but also to bring the flange 218 into engagement with the surface 178 of the slot 170. This moves the slide 127 relative to the base 125 to a second position where the associated holes 172 and 158 are not aligned as illustrated in FIG. 7. This results in blocking fluid communication between the tube 214 and the tube 25 thereby preventing the bleeding of air from the float 63. The float 63 remains fully buoyant extending the period of the flushing operation and resulting in a higher flush water volume.

The resulting structure not only provides for two different flush volumes, but also provides for variation or adjustment of the lesser flush volume. This results from varying the pressure within the pressure tube 25 so that when it is in fluid communication with the tube 214, air is bled from the float 63 at an adjustable rate. This pressure in the tube 25 is controlled by varying the distance that the tube 25 extends into the water 16 in the tank 14. When the tube 25 is adjusted to extend a greater distance into the water 16, its pressure increases thereby reducing the rate of air release from the float 63. With a decrease in this rate of air flow, the buoyancy of the float 63 is reduced over a longer period of time resulting in a longer flushing period and a greater flush water volume.

The resulting structure of the flush valve assembly 18 of this embodiment provides for simplified mounting of the assembly 18 by facilitating axial adjustment through the structure 32 and radial alignment of the selector assembly 36 relative to the slot 98. A flushing operation with two different flush volumes is further characterized by variations which are possible for the smaller flush volume.

Of course it will be appreciated that there are many variations on the structure of this preferred embodiment which will now be apparent. Clearly the push buttons 198 and 201 can be replaced with other actuator mechanisms to achieve the dual-flush capability. Structures other than the slide assembly 123 can also be used to facilitate or inhibit fluid communication between the tubes 214 and 25.

Another modification might include the addition of a second pressure tube, such as the pressure tube 25. This second pressure tube could be disposed in fluid communication with the tube 214 when the slide subassembly 123 is in the position associated with the larger flush volume. In such an embodiment, the end of the second pressure tube would extend more deeply into the water in the tank than the end of the pressure tube 25 associated with the smaller flush volume. This modification would result in an embodiment wherein both the larger flush volume and the smaller flush volume are adjustable in the manner disclosed.

Many modifications will also be possible with respect to the axial adjustment structure 32. A structure which facilitates not only axial adjustment but also rotation about the axis 28 is of course preferred.

Due to the many variations which are possible, one is cautioned not to limit the concept to the embodiments illustrated and disclosed, but rather to determine the scope of the invention only with reference to the following claims.

What is claimed is:

1. A toilet, comprising:

a bowl adapted to receive waste to be flushed;

a tank providing a reservoir of water to flush the bowl;

a flush valve assembly disposed in the tank and operable to release the water into the bowl in a first volume associated with the flushing of liquid waste and a second volume greater than the first volume associated with the flushing of solid waste;

a selector apparatus included in the flush valve assembly and accessible from outside the tank, for initiating a flushing operation and for selecting one of the first flush volume and the second flush volume;

a flush valve included in the flush valve assembly and responsive to operation of the selector apparatus to release the water into the bowl;

the flush valve being responsive to operation of the selector apparatus to select the first flush volume by opening the flush valve at the beginning of a first time period associated with the first flush volume, and by closing the flush valve at the end of the first time period associated with the first flush volume;

the flush valve being responsive to operation of the selector apparatus to select the second flush volume by opening the flush valve at the beginning of a second time period associated with a second volume and by closing the flush valve at the end of the second time period associated with the second flush volume;

the second time period being greater than the first time period;

the first time period being adjustable to vary the first flush volume;

a float having at least one wall defining a hollow chamber;

first portions of the wall defining at least one water inlet for receiving the water at a first water entry rate associated with the first flush volume, and a second water entry rate associated with the second flush volume; and the second water entry rate being less than the first water entry rate.

2. The toilet recited in claim 1, wherein the float further comprises:

second portions of the wall defining at least one air outlet hole for releasing air from the chamber at a first air release rate associated with the first water entry rate, and a second air release rate associated with the second water entry rate; and the second air release rate being less than the first air release rate.

3. The toilet recited in claim 2, wherein the selection apparatus comprises:

a first selector operable to initiate the flushing operation and to select the first flush volume;

a second selector operable to initiate the flushing operation and to select the second flush volume; and a tube disposed in fluid communication with the air release outlet hole in the float; and the tube being sealed in response to operation of the second selector, and being open in response to operation of the first selector.

4. The toilet recited in claim 3, wherein the selector assembly includes:

a first push button operable to select the first flush volume; and a second push button operable to select the second flush volume.

5. A method for flushing a toilet to alternatively initiate a flushing operating with a first flush water volume and a second flush water volume greater than the first flush water volume, including the steps of:

providing a selector apparatus having a first actuator associated with the first flush water volume and a second actuator associated with a second flush water volume, and a hollow float;

operating the first actuator to initiate the flushing operation with the first flush water volume;

operating the second actuator to initiate the flushing operation with the second flush water volume;

during the first operating step, introducing water into the hollow float at a first rate dependent upon the first flush water volume;

during the second operating step, introducing water into the hollow float at a second rate less than the first rate and dependent upon the second flush water volume.

6. The method for flushing a toilet recited in claim 5, wherein:

the providing step includes a step of providing the selector apparatus having the first actuator in the form of a first button and the second actuator in the form of a second button;

the first operating step includes the step of pushing the first button; and the second operating step includes the step of pushing the second button.

7. The method for flushing a toilet recited in claim 6, wherein the first operating step further comprises the steps of:

initiating the flushing operation by pushing the first button; and selecting the first flush water volume by pushing the first button.

8. The method for flushing a toilet recited in claim 7, wherein the initiating step and the selecting step occur substantially simultaneously.

9. A toilet, comprising:

a bowl adapted to receive waste to be flushed;

a tank providing a reservoir water to flush the bowl;

a flush valve assembly disposed in the tank and operable to release the water into the bowl in a first volume associated with the flushing of liquid waste and a second volume greater than the first volume associated with the flushing of solid waste;

a float having at least one wall defining a hollow chamber;

first portions of the wall defining at least water inlet for receiving water at a first water entry rate associated with the first flush volume, and a second water entry rate associated with a second flush volume;

the second water entry rate being greater than the first water entry rate.

10. The toilet recited in claim 9, wherein the float further comprises:

second portions of the wall defining at least one air outlet hole for releasing air from the hollow chamber at a first air release rate associated with the first water entry rate, and a second air release rate associated with a second water entry rate; and the second air release rate being less than the first air release rate.

* * * * *